US011788691B2

(12) United States Patent
Hong et al.

(10) Patent No.: US 11,788,691 B2
(45) Date of Patent: Oct. 17, 2023

(54) HIDDEN LIGHTING LAMP USING COLOR CONVERSION MATERIALS AND VEHICLES HAVING SAME

(71) Applicants: HYUNDAI MOTOR COMPANY, Seoul (KR); KIA CORPORATION, Seoul (KR); HYUNDAI MOBIS CO., LTD., Seoul (KR)

(72) Inventors: Seung-Pyo Hong, Incheon (KR); Yun-Min Cho, Seoul (KR); Ju-Hyun Kim, Suwon-si (KR); Chang-Hwan Oh, Uiwang-si (KR); Jung-Woo Shin, Daegu (KR); Dong-Joo Park, Hwaseong-si (KR); Han-Soo Park, Yongin-si (KR)

(73) Assignees: HYUNDAI MOTOR COMPANY, Seoul (KR); KIA CORPORATION, Seoul (KR); HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 17/890,007

(22) Filed: Aug. 17, 2022

(65) Prior Publication Data

US 2023/0073432 A1 Mar. 9, 2023

(30) Foreign Application Priority Data

Sep. 3, 2021 (KR) ..... 10-2021-0117452

(51) Int. Cl.
*F21K 9/64* (2016.01)
*F21S 41/25* (2018.01)
(Continued)

(52) U.S. Cl.
CPC ..... *F21K 9/64* (2016.08); *F21S 41/151* (2018.01); *F21S 41/25* (2018.01); *F21Y 2115/10* (2016.08)

(58) Field of Classification Search
CPC ..... F21K 9/64; F21S 41/25; F21S 41/151
See application file for complete search history.

(56) References Cited

U.S. PATENT DOCUMENTS 4,872,745 A * 10/1989 Fujisawa ..... B60Q 1/04 359/267
6,550,949 B1 * 4/2003 Bauer ..... B60Q 1/0023 362/800

(Continued)

FOREIGN PATENT DOCUMENTS

JP 2013102078 A 5/2013
JP 2018185945 A 11/2018
KR 20150090458 A 8/2015

*Primary Examiner* — Bryon T Gyllstrom
(74) *Attorney, Agent, or Firm* — LEMPIA SUMMERFIELD KATZ LLC

(57) ABSTRACT

A hidden lighting lamp uses a color conversion material and is applied to a vehicle. A color conversion member is spaced apart from a light source by a light source air gap (La) such that the color conversion member is integrally engaged with a lens for projecting light of the light source to the outside or such that the color conversion member is spaced apart from the lens by a lens air gap (Lb). Hidden lighting without deterioration of optical efficiency of LED light from the light source is thereby implemented. One or more of a black painting, a coating layer, an application layer, and a deposition layer are provided, thereby providing concealment of the lamp inner space of the lens, anti-peeling of a deposit, and diversity of fluorescent color.

20 Claims, 8 Drawing Sheets

(51) Int. Cl.
*F21S 41/151* (2018.01)
*F21Y 115/10* (2016.01)

(56) References Cited

U.S. PATENT DOCUMENTS

2004/0150991 A1* 8/2004 Ouderkirk ..... H01L 33/46
362/800
2004/0239243 A1* 12/2004 Roberts ..... B60Q 1/2665
257/E25.02
2012/0057325 A1* 3/2012 Hikmet ..... H01L 33/58
362/558
2015/0263239 A1* 9/2015 Watanabe ..... H01L 33/62
362/293
2016/0131354 A1* 5/2016 Kim ..... F21V 29/502
362/84
2017/0198874 A1* 7/2017 Matsunami ..... F21S 10/026
2021/0362645 A1* 11/2021 Lee ..... F21S 43/31

* cited by examiner

OUTSIDE LAMP ⟷ INSIDE LAMP

<INSIDE SPACE CONFIGURATION OF A>

HIDDEN LIGHTING LAMP USING COLOR CONVERSION MATERIALS AND VEHICLES HAVING SAME

CROSS-REFERENCE TO RELATED APPLICATION

This application claims priority to Korean Patent Application No. 10-2021-0117452, filed on Sep. 3, 2021, which is incorporated herein by reference in its entirety.

BACKGROUND

Field of the Disclosure

The present disclosure relates to a hidden lighting lamp in which a color conversion material, which is an element for performing a color conversion function and covering the inside of the lamp as well, is applied onto a lens to implement hidden lighting without deterioration of optical efficiency. More particularly, the present disclosure relates to a vehicle to which a hidden lighting lamp is applied.

Description of Related Art

Recently, vehicle lamp systems have been developed into hidden lighting lamp technology due to the commercialization of electric vehicles or the like.

In the related art, the hidden lighting lamp is implemented by applying a light-emitting diode (LED) chip (or chip LED), a lens, a phosphor (i.e., a fluorescent material), a black paint, a coating layer, a cover layer, and a deposition layer.

For example, the hidden lighting lamp may coat the LED chip with phosphor to form an LED-phosphor layer in which LED light is changed into various colors of inside light in an inner space of a lamp. The hidden lighting lamp may apply any one or more of a black paint, a coating layer, a cover layer, and a deposition layer onto the lens to form a lens-attachment layer in which external light is partially reflected and transmitted so that the lamp inner space can be blocked from being recognized from the outside.

As such, the hidden lighting lamp is configured such that when the LED is not turned on, the hidden lighting lamp is not recognized from the outside through the black paint. However, when the LED is turned on, the hidden lighting lamp creates a lighting image for the lamp and its surroundings with various colors beyond the unique lighting function through phosphor, thereby breaking away from the simple and fixed classic lighting image.

Therefore, with the implementation of design factor, the hidden lighting lamp can greatly contribute to the improvement of vehicle marketability by enhancing various and luxurious lamp images and sophisticated and high-tech image effects in vehicles, particularly electric vehicles.

However, in the hidden lighting lamp, approximately 80% of the energy emitted from the LED chip is reflected back into the lamp, which deteriorates the heat dissipation performance. In particular, the black paint, coating layer, cover layer, deposition layer, and phosphor layer applied for hidden lighting deteriorates the optical efficiency of the LED chip, which becomes one of the causes of the reduction in fuel efficiency of electric vehicles among vehicles.

In general, in the case of hidden lighting, approximately 80% of the energy emitted from the LED is reflected back into the lamp, resulting in deterioration of heat dissipation performance. In addition, since the hidden lighting lamp needs to satisfy automobile chromaticity regulations like existing lamps, it is difficult to match the external paint color around the lamp in a state where the lamp is not turned on.

Furthermore, the hidden lighting lamp has design requirements, including invisibility of the lamp inner space, anti-peeling of a deposit, increased light transmittance, the diversity of fluorescent color, reduced volatile organic compounds (VOCs), and the like. In order to meet these design requirements, it is necessary to optimize the application structure of phosphor and black paint. The VOCs refer to volatile organic compounds in a gas or liquid phase that have a high vapor pressure and easily evaporate into the atmosphere. Further, the phosphor coated on the LED chip is generated at a high temperature of the LED.

For example, in the LED phosphor layer of the hidden lighting lamp, the phosphor, which generates light converted energy by the LED chip, directly receives the high-temperature light energy generated from the LED chip. Thus, the VOCs' robustness is greatly reduced. Further, it is difficult to implement various fluorescent colors of the phosphor, so the phosphor is limited in increasing the value of the color rendering index (CRI).

In addition, in the lens-attachment layer of the hidden lighting lamp, the black paint, coating layer, cover layer, and deposition layer have difficulty in providing both invisibility of the lamp inner space through the lens and anti-peeling of a deposit from the lens surface. In particular, an Al-deposited site may be decomposed with water droplets formed on the lens surface.

In addition, in the structure of the hidden lighting lamp, since the LED chip is positioned behind the lens, the LED phosphor layer and the lens-attachment layer are spaced a predetermined distance from each other. Such a distance requires the transfer of the phosphor light from the phosphor layer. Thus, there is a limit in increasing the light transmittance for the lens.

The contents described in the Description of Related Art section are to help understand the background of the present disclosure. The contents described in Description of Related Art section thus may include what is not previously known to those having ordinary skill in the art to which the present disclosure pertains.

SUMMARY

Considering the above point, an object of the present disclosure is to provide a hidden lighting lamp in which phosphor, which is a color conversion material for covering the inner space of the lamp while performing a color conversion function, is used in a lens. The phosphor is used to implement hidden lighting without deteriorating optical efficiency. Thus, in particular, the phosphor in the lens matches with one or more of a black paint, a coating layer, a cover layer, and a deposition layer to improve inside invisibility of a lens, anti-peeling of a deposit, and the diversity of fluorescent color. Further, the phosphor maintains the VOCs' robustness and increases light transmittance through a light source air gap of a lens and an LED. Further, an object of the present disclosure is to provide a vehicle having the same.

A hidden lighting lamp according to the present disclosure for achieving the above objectives is provided. The hidden lighting lamp includes: a light source; a lens projecting light of the light source to the outside; and a color conversion member. The color conversion member is spaced apart from the light source by a light source air gap (or a first air gap) to form a transmission path of light energy emitted from the light source. The color conversion member is also integrally engaged with the lens or separated from the lens by a lens air gap (or a second air gap), in a state of being spaced apart from the light source by the light source air gap (or the first air gap).

In one embodiment, the light source is a light emitting diode (LED) chip.

In one embodiment, the color conversion member includes a rear-phosphor layer allowing external light having transmitted through the lens to be blocked and to transmit light emitted from the light source therethrough. The color conversion member further includes a phosphor layer provided in close contact with the rear-phosphor layer and allowing light from the rear-phosphor layer to be transmitted therethrough in a wavelength-converted state. Further, the color conversion member includes a front-phosphor layer allowing light from the phosphor layer to be transmitted therethrough to the lens to reduce external visibility for the lens when the light source is not turned on.

In one embodiment, the phosphor layer is modified into a plurality of phosphor layers having different phosphor colors by varying the thickness or added amount of a phosphor material. A phosphor composition change or a combination of the phosphor material with other materials is performed to improve the color rendering index (CRI).

In one embodiment, the phosphor layer is composed of a plurality of color phosphor particles having different phosphor colors. The color phosphor particles are contained in the rear-phosphor layer.

In one embodiment, the rear-phosphor layer contains an additive having the same color base as the light from the light source and an additional additive to adjust the light transmittance.

In one embodiment, the rear-phosphor layer is modified into a plurality of transparent layers, each containing a plurality of color phosphor particles having different colors.

In one embodiment, the color conversion member is modified into an optical feature having an optical function with any one of a convex part, a concave part, and a Fresnel cut part applied thereto.

In one embodiment, the front-phosphor layer forms an integrated structure or a separated structure with respect to the lens. The front-phosphor layer is modified into any one of a deposition layer, a painting layer, a top coating layer, a color painting layer, and a base coating layer.

In one embodiment, a light transmission hole is formed in each of the deposition layer, the coating layer, the top coating layer, the color coating layer, and the base coating layer to increase the light transmittance.

In one embodiment, the deposition layer is formed of an aluminum (Al) material or a nickel-chromium (Ni—Cr) material.

In one embodiment, the painting layer is formed of a paint, and the color painting layer is formed of a paint of various colors suitable for the realization of design aesthetics.

In one embodiment, the top coating layer is combined with the deposition layer to prevent delamination of the deposition layer.

In one embodiment, the base coating layer is combined with the deposition layer and the top coating layer to prevent delamination of the deposited layer. Alternatively, the base coating layer is combined with the color painting layer and the top coating layer to prevent delamination of the color painting layer.

Further, a vehicle according to the present disclosure for achieving the above objectives is provided. The vehicle includes an exterior component and a hidden lighting lamp. The hidden lighting lamp is provided in a vehicle part where the exterior component is disposed and includes a color conversion member integrally engaged with a lens for projecting light of a light source to the outside or separated from the lens by a lens air gap, in a state of being spaced apart from the light source by a light source air gap.

In one embodiment, the hidden lighting lamp is any one of a headlamp, a tail lamp, a fog lamp, a turn signal lamp, a side repeater, an emergency light, a brake lamp, or a backup lamp.

The hidden lighting lamp, using the color conversion material applied to a vehicle according to the present disclosure, implements the following operations and effects.

First, the phosphor layer is applied to the lens and separated from the LED chip to greatly reduce the degree of re-reflection of inside light into the lamp. Deterioration of heat dissipation performance and deterioration of optical efficiency are thereby prevented.

Second, the phosphor layer is applied to the lens to form a hidden structure in which one or more of a black paint, a coating layer, a cover layer, and a deposition layer are applied to prevent the decrease in optical efficiency of the LED chip. Thus, one of the causes of reduction in fuel efficiency of vehicles, especially electric vehicles applied with the hidden lighting lamp, is resolved.

Third, the lens-coated phosphor layer is applied so that invisibility of the lamp inner space, anti-peeling of a deposit, increased light transmittance, implementation of diverse fluorescent color, and VOCs' robustness are maintained. These are all essential features of a hidden lighting lamp, which can all be satisfied or improved.

Fourth, the removal of the main/sub/rim bezel among lamp design components, the reduction in the number of LEDs, the size of the heat dissipation structure/lamp, and the removal of the phosphor layer of the LED chip are obtained by the hidden structure and increased optical efficiency through the lens-coated phosphor layer. Cost reduction is thereby also achieved.

Fifth, the fuel efficiency of a vehicle can be increased through the reduction in the light capacity due to the increase in LED utilization rate. Further, the optical efficiency can be increased due to the decrease in the junction temperature according to the separation of the LED chip and the phosphor.

Sixth, marketability is improved by the implementation of the optical function of key color (i.e., Chroma Key) hidden lighting and color hidden lighting of a bumper, which is an exterior component. In particular, the degree of freedom in vehicle and lamp design using improved optical transmittance can be maximized.

Seventh, the phosphor layer, which is an existing component, is used as an element to cover the inner space of the lamp while performing the color correction function so as to match with the exterior paint color of the vehicle body. Thus, the external visibility is improved when the lamp is not turned on, and the vehicle chromaticity regulations are satisfied when the lamp is turned on.

DESCRIPTION OF SPECIFIC EMBODIMENTS

Hereinafter, embodiments of the present disclosure are described in detail with reference to the accompanying drawings. The embodiments are illustrative and may be implemented by those having ordinary skill in the art to which the present disclosure pertains in various different forms. Thus, the present disclosure is not limited to the embodiments described herein.

Figure 1:
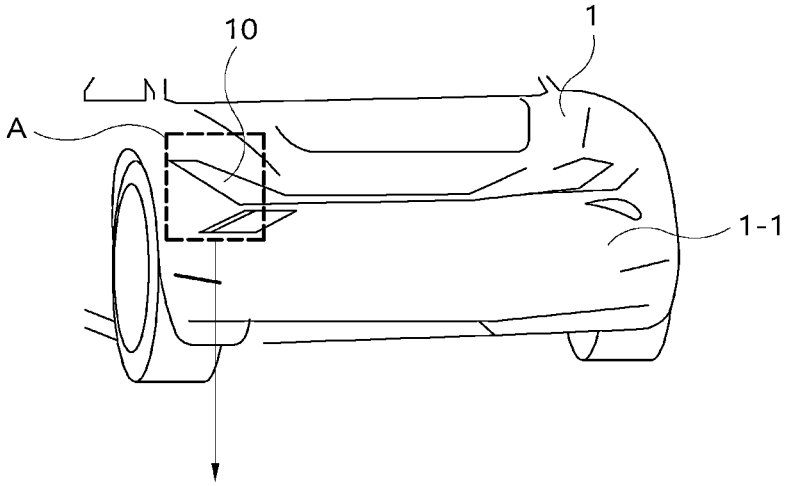
FIG. 1 is a diagram illustrating the configuration of a hidden lighting lamp using a color conversion material applied to a vehicle according to the present disclosure.
Figure 1:
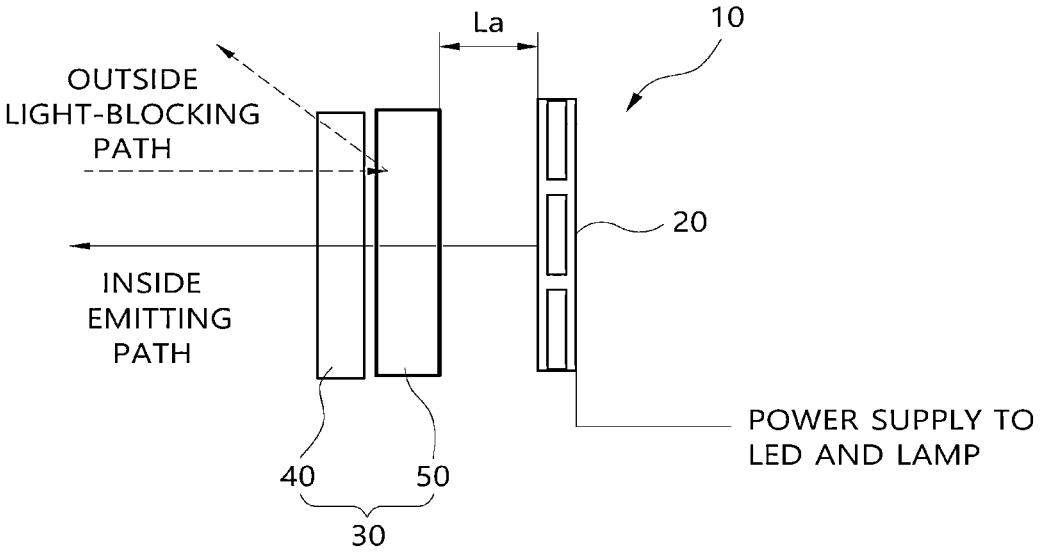
Figure 2:
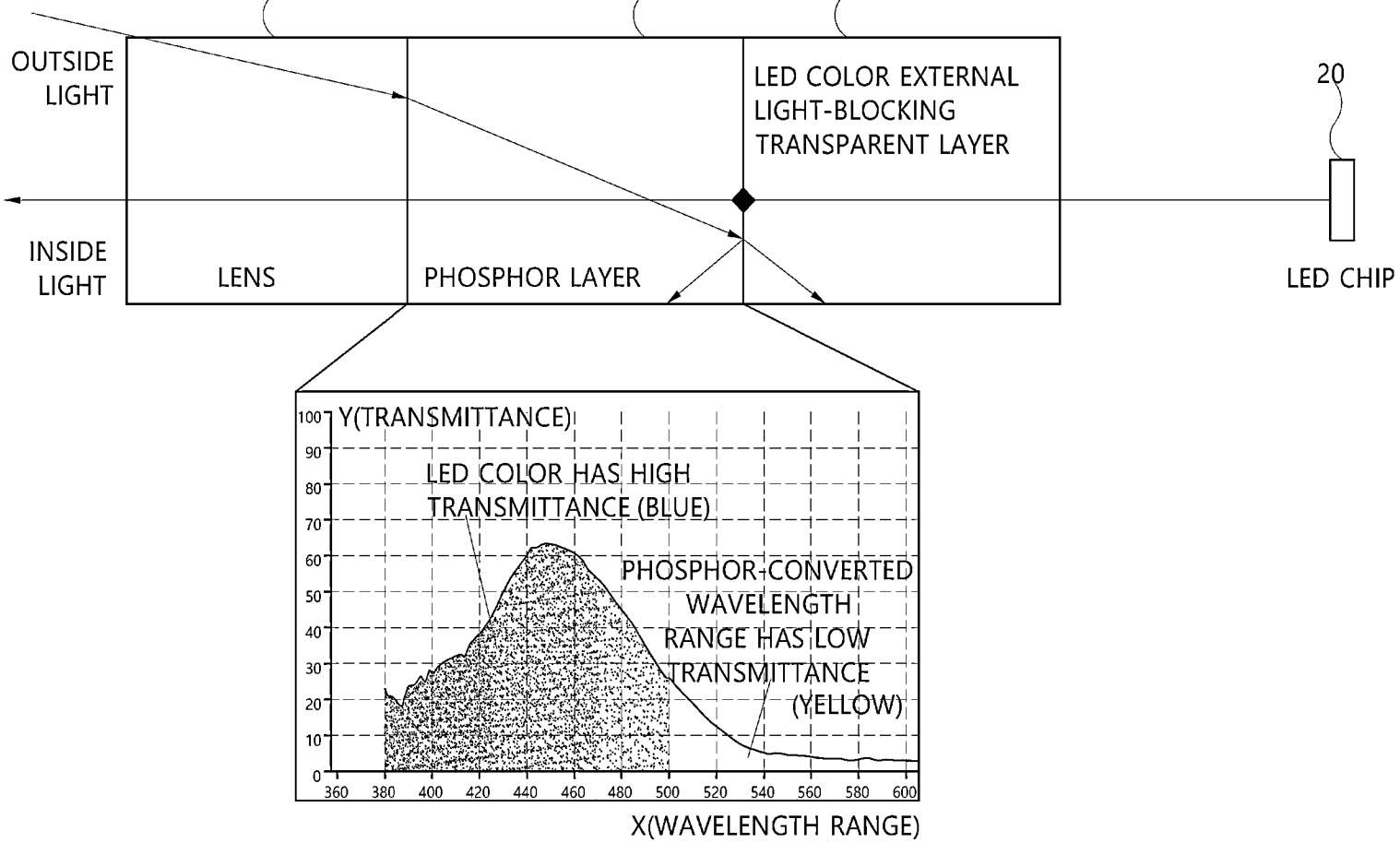
FIG. 2 is a diagram illustrating the state in which inside light passes and external light is blocked through phosphor, which is a color conversion material, in the lens of the hidden lighting lamp according to the present disclosure.

FIG. 1 and FIG. 2 illustrate components of a hidden lighting lamp 10.

Referring to FIG. 1, a vehicle 1 includes a hidden lighting lamp 10. The hidden lighting lamp 10 is illustrated as a headlamp provided in the exterior part 1-1 (e.g., bumper) of the front side of the vehicle. The hidden lighting lamp may not only be a tail lamp provided on the rear side of the vehicle but may also be any one of a fog lamp, a turn signal lamp, a side repeater, an emergency light, a brake lamp, and/or a backup lamp.

For example, the hidden lighting lamp 10 is composed of a light source 20 that generates light into the inner space of the lamp, and a hidden lens 30 is disposed in front of the light source 20 with a light source air gap La (or a first air gap La) interposed therebetween. The light source 20 is a light-emitting diode (LED) chip, which is generally referred to as an LED that generates light during current application according to the principle of a PN junction light-emitting diode. The LED includes a plurality of LEDs that respectively emit light of various colors having a wavelength of 400 nm to 500 nm.

In particular, the hidden lens 30 is essentially composed of a lens 40 and a color conversion member 50. The lens 40 is an outer lens that is an externally exposed part through which inside light is emitted from the light source to the outside of the lamp. The lens 40 is also formed of any one of polycarbonates (PC) plastic, glass, and polymethyl methacrylate (PMMA).

In addition, the color conversion member 50 serves to block external light (e.g., sunlight) while performing color correction for the inside light generated when the light source 20 is turned on. The color conversion member 50 is formed in an integrated structure with the lens 40. However, if necessary, the color conversion member 50 may be formed in a separated structure with respect to the lens 40 (see FIG. 5).

In addition, the light source air gap La (or the first air gap La) forms a propagation distance of light from the light source 20 to the color conversion member 50. The propagation distance is also referred to as an anti-phosphor-deterioration distance of phosphor, which is applied to the color conversion member 50. This anti-phosphor-deterioration distance allows a high-temperature light energy transmitted from the LED of the light source 20 directly to the phosphor to be greatly mitigated, thereby contributing to securing the VOCs' robustness for the phosphor of the color conversion member 50 and improving the thermal performance of the LED chip of the light source 20.

Therefore, the hidden lighting lamp 10 is characterized as a hidden lighting lamp using a color conversion material.

In FIG. 2, the black and white graph describes a system including a phosphor layer that converts light to a transparent lens and an LED CHIP of the same color as an outside light blocking layer that efficiently penetrates the same color as the LED CHIP. In the graph, the x-axis is the wavelength range (nm), and the y-axis is the transmittance (%). The wavelength range with high transmittance is the same wavelength range as the LED CHIP (blue), and the wavelength range with low transmittance is the same wavelength range as the outside light and phosphor (yellow).

Referring to FIG. 2, the color conversion member 50 is composed of a phosphor layer 60 that converts light in the transparent lens 40 and a rear-phosphor layer 70 (or LED color external light-blocking transparent layer) that efficiently transmits the same color as the LED chip.

For example, the phosphor layer 60 applies phosphor as a color conversion material that performs color correction by changing the light wavelength of the inside light generated by the LED when the light source 20 is turned on.

In particular, when receiving light with a wavelength of 400 nm to 500 nm, the phosphor layer 60 is excited into light of approximately 550 nm wavelength and then returns to the ground state so as to convert the LED light of the light source 20 into light having a long wavelength of 400 nm to 700 nm.

In addition, the phosphor layer 60 may change in composition or have a combined composition with other materials to expand the width of a wavelength of converted light so as to improve color rendering index (CRI) (i.e., to increase the value of CRI). Further, since the phosphor layer 60 has a tendency to have a warm feeling (WARM) chromaticity in order to match the white chromaticity or as the deposition amount on the lens 40 increases, the amount of phosphor used for the WARM color can be reduced.

For example, the rear-phosphor layer 70 is a transparent layer that protects the phosphor of the phosphor layer 60 and blocks a portion of light due to an LED color-based additive and other additives so that the light transmittance becomes approximately 99% or less.

In particular, the rear-phosphor layer 70 significantly reduces or eliminates the LED color, thereby increasing the light transmittance and thus improving optical efficiency.

Therefore, if a phosphor protection material is already added to or mixed with the phosphor composition of the phosphor layer 60 in the color conversion member 50, the color conversion member 50 may be only composed of the phosphor layer 60 without the rear-phosphor layer 70.

Furthermore, the color conversion member 50 forms an integrated structure with the lens 40 by positioning the phosphor layer 60 toward the lens 40 and positioning the rear-phosphor layer 70 toward the light source 20. The reason for this is as follows. If the phosphor layer 60 is positioned closer to the light source 20 than the rear-phosphor layer 70, light is first converted in the phosphor layer 60 and then transmits through the rear-phosphor layer 70, so that a portion of the converted light is blocked by the rear-phosphor layer 70, resulting in decreased light transmittance and a color shift. Thus, enabling the LED light having an LED color emitted from the light source 20 to first meet the rear-phosphor layer 70 prior to the phosphor layer 60 can increase the light transmittance.

In this way, the color conversion member 50 is arranged in the order of the lens 40—the phosphor layer 60—the rear-phosphor layer 70 in a state of being spaced apart from the light source 20. Thus, the rear-phosphor layer 70 effectively transmits the LED spectrum in the lamp inner space, thereby reducing the decrease in optical efficiency. Further, the external light (e.g., sunlight) that can transmit through both the phosphor and the layers 60 and 70, used for blocking external light, is effectively blocked, thereby effectively implementing the hidden lighting. In this case, "-" means an arrangement state that is arranged in the front-rear direction.

In particular, since the phosphor layer 60 is directly located on the lens 40, re-reflectance decreases due to the exclusion of the physical distance, and thus improved light transmittance is utilized so that the same amount of light is emitted with less power consumption, thereby possibly increasing the energy efficiency. The characteristic solves the disadvantage that, in the case of the lens 40 and the phosphor layer 60 being separated as in the related art, due to a decrease in the transmittance of light from the light source 20, a large number of LEDs are required to implement a lighting function.

Figure 3:
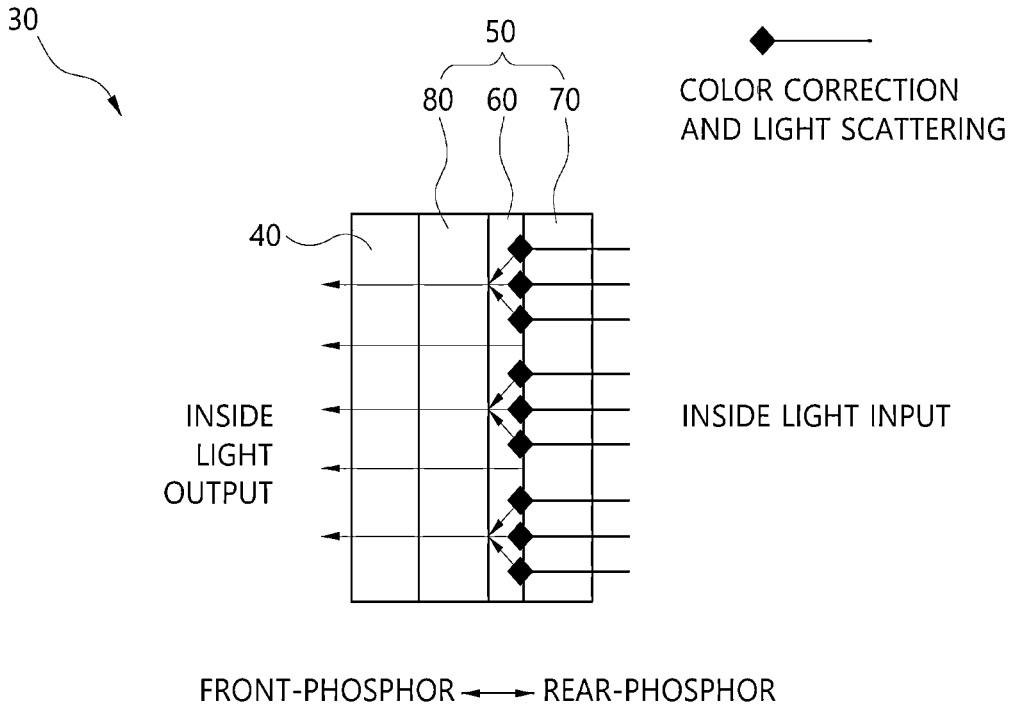
FIG. 3 is a diagram illustrating the configuration of a hidden lens through phosphor, which is a color conversion material, in the lens of the hidden lighting lamp according to the present disclosure.

On the other hand, referring to FIG. 3, the color conversion member 50 is composed of a phosphor layer 60 that converts light in a transparent lens 40, a rear-phosphor layer 70 (or LED color external light-blocking transparent layer) that efficiently transmits the same color as the LED chip, and a front-phosphor layer 80 (or lens-attachment layer).

For example, the front-phosphor layer 80 is formed of an aluminum (AL) material interposed between the lens 40 and the phosphor layer 60 to allow inside light to be transmitted while reflecting external light (e.g., sunlight), thereby contributing to the concealment of the internal components of the lamp when the light source 20 is not turned on. In this case, the aluminum (AL) can be replaced with other materials. Among these materials, although chromium (Cr) material can be used at low temperatures, cracks may occur at high temperatures. Therefore, a single Cr material is not solely adapted, but nickel-chromium (Ni—Cr) material may be applied.

In particular, the front-phosphor layer 80 may be formed by painting or coating, in addition to deposition.

Figure 4:
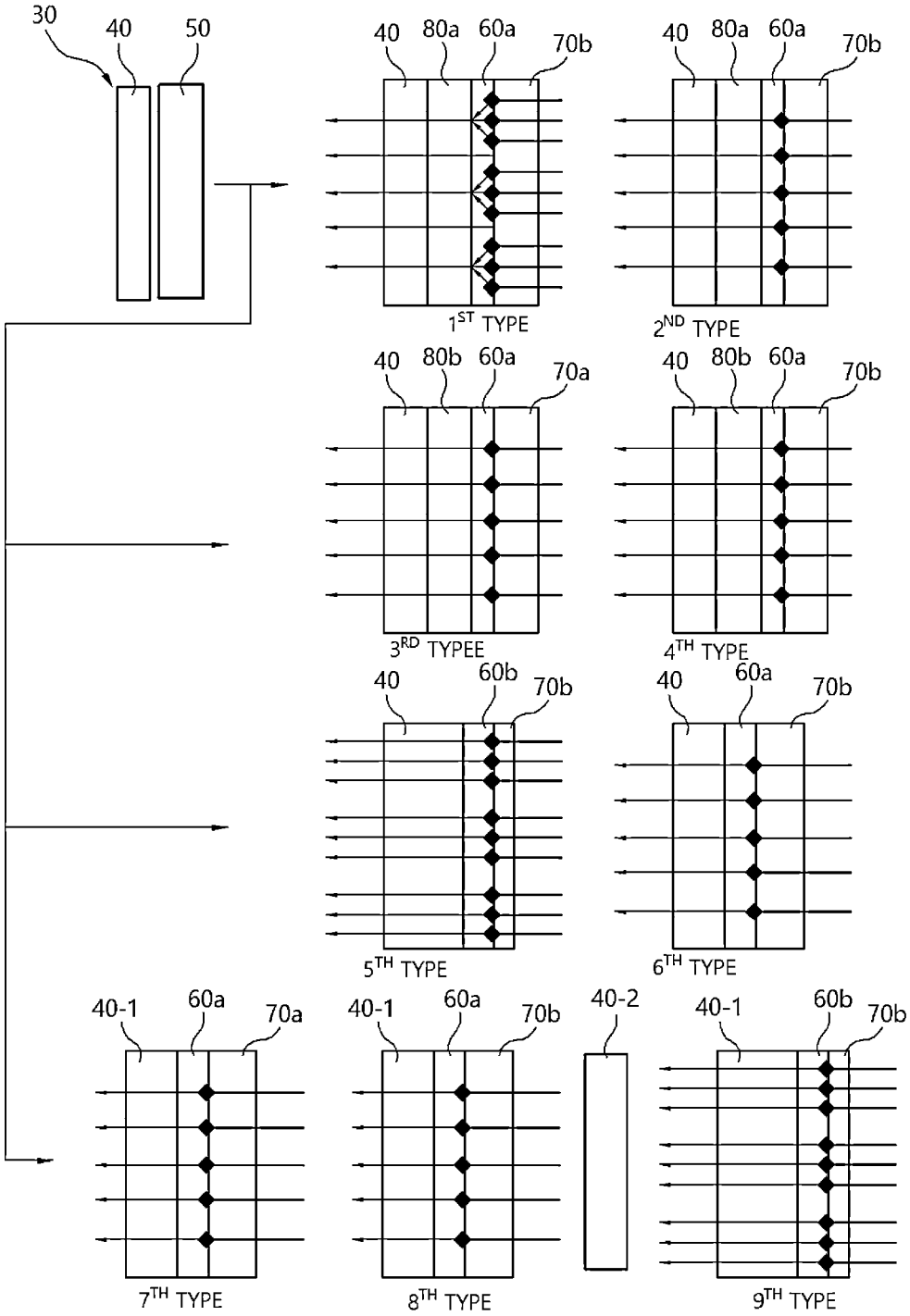
FIG. 4 is a diagram illustrating the configuration in which the lens and the color conversion member of the hidden lens are variously configured in an integrated structure according to the present disclosure.
Figure 5:
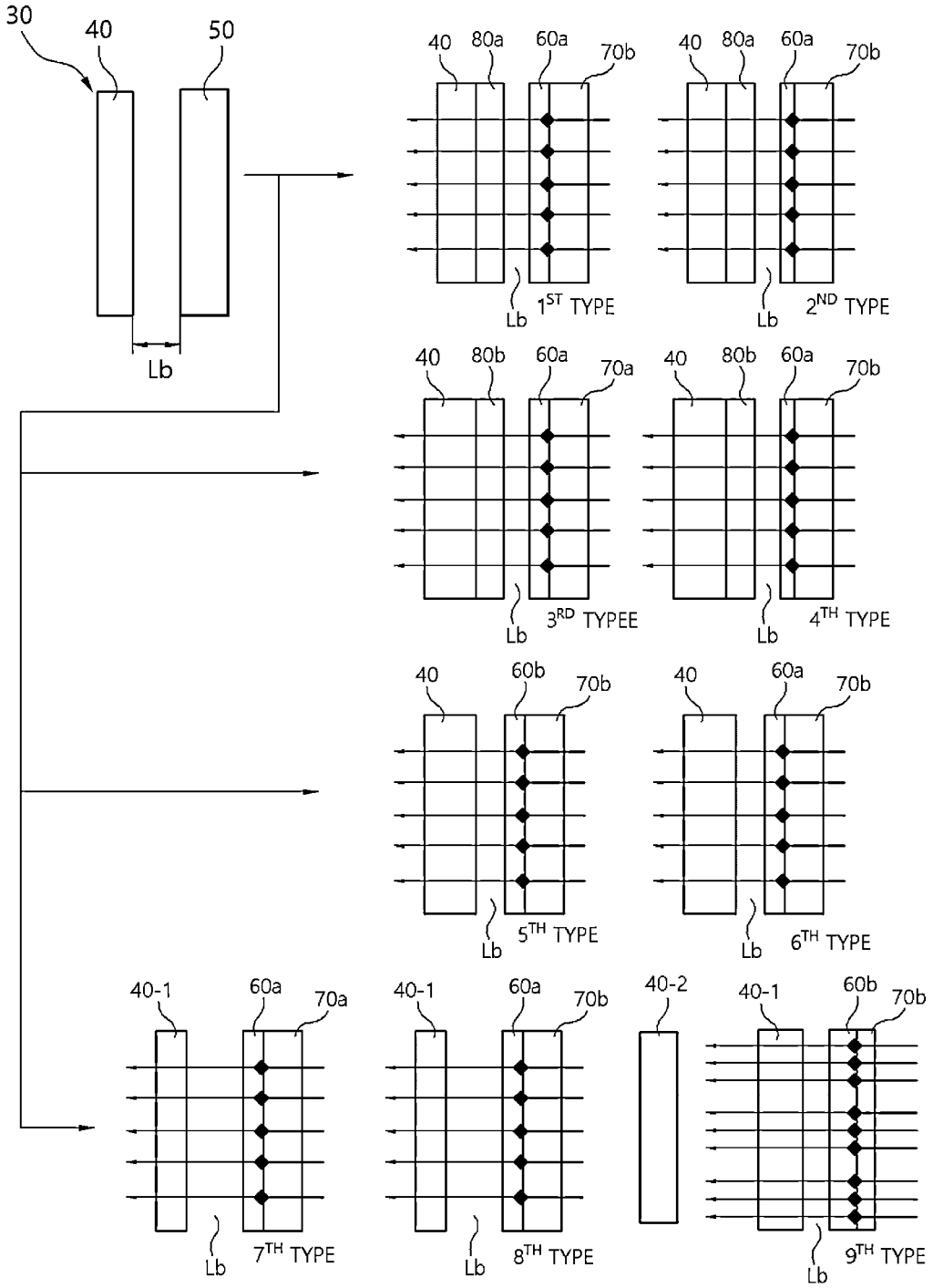
FIG. 5 is a diagram illustrating the configuration in which the lens and the color conversion member of the hidden lens are variously configured in a separated structure according to the present disclosure.

Meanwhile, FIGS. 4 and 5 illustrate a hidden lens 30 having an integrated structure of a lens 40 and a color conversion member 50 and a separated structure of a lens 40 and a color conversion member 50, respectively.

Referring to the integrated structure type hidden lens 30 of FIG. 4, the lens 40 may be replaced with a plastic exterior part 40-1 or a color plastic exterior part 40-2. In the color conversion member 50, the phosphor layer 60 may be composed of a first phosphor layer 60*a* or a second phosphor layer 60*b*. The rear-phosphor layer 70 may be composed of a first transparent layer 70*a* or a second transparent layer 70*b*, and the front-phosphor layer 80 may be composed of a deposition layer 80*a* or a painting layer 80*b*.

On the other hand, referring to the separated structure type hidden lens 30 of FIG. 5, among the phosphor layer 60, the rear-phosphor layer 70, and the front-phosphor layer 80 of the color conversion member 50, the front-phosphor layer 80 or the phosphor layer 60 is spaced away backward from the lens 40 with a lens air gap Lb (or a second air gap Lb) interposed therebetween. In this case, the lens air gap Lb serves to scatter the inside light transmitted from the phosphor layer 60 into the empty space of the lens air gap between the lens 40 and the phosphor layer 60, which contributes to the effective use of light.

In this arrangement, the integrated structure type hidden lens 30 may be modified into first to ninth (1 to 9) iterations of integrated structure type hidden lenses 30. The separated structure type hidden lens 30 may be modified into first to ninth (1 to 9) iterations of separated structure type hidden lenses 30. Hereinafter, "-" means an arrangement state that is arranged in the front-rear direction.

For example, each of the first and second integrated structure type hidden lenses 30 is composed of a lens 40—a deposition layer 80*a*—a first phosphor layer 60*a*—a second transparent layer 70*b*. In addition, each of the first and second separated structure type hidden lenses 30 is composed of a lens 40—a deposition layer 80*a*—a lens air gap Lb (or a second air gap Lb)—a first phosphor layer 60*a*—a second transparent layer 70*b*.

In this arrangement, the lens 40 is a transparent lens, and the deposition layer 80*a* is formed of Al or Ni—Cr material that reflects external light. Further, in this arrangement the first phosphor layer 60*a* is formed of phosphor that converts a 400 to 500 nm wavelength to a long wavelength of 400 to 700 nm. The second transparent layer 70*b* is added with an LED color-based additive and other additives to protect the first phosphor layer 60*a* while blocking a part of light.

Therefore, the first and second integrated/separated structure type hidden lenses 30 may be formed differently by varying the thickness or added amount of the deposition layer 80*a* or the second transparent layer 70*b* with respect to the first phosphor layer 60*a*.

For example, the third integrated structure type hidden lens 30 is composed of a lens 40—a painting layer 80*b*—a first phosphor layer 60*a*—a first transparent layer 70*a*. The third separated structure type hidden lens 30 is composed of a lens 40—a painting layer 80*b*—a lens air gap Lb (or a second air gap Lb)—a first phosphor layer 60*a*—a first transparent layer 70*a*. In addition, the fourth integrated structure type hidden lens 30 is composed of a lens 40—a painting layer 80*b*—a first phosphor layer 60*a*—a second transparent layer 70*b*. The fourth separated structure type hidden lens 30 is composed of a lens 40—a painting layer 80*b*—a lens air gap Lb (or a second air gap Lb)—a first phosphor layer 60*a*—a second transparent layer 70*b*.

In this arrangement, the lens 40 is a transparent lens, and the painting layer 80*b* is a layer that reflects external light while enhancing the aesthetic sensibility in design of a color paint of various colors. Further in this arrangement, the first phosphor layer 60*a* is formed of phosphor that converts light having a 400 nm to 500 nm wavelength to light having a long wavelength of 400 to 700 nm. The first transparent layer 70*a* and the second transparent layer 70*b* are added with an LED color-based additive and other additives to protect the first phosphor layer 60*a* while blocking a part of light.

Therefore, the third integrated/separated structure type hidden lens 30 or the fourth integrated/separated structure type hidden lens 30 may be formed differently by changing a color of the painting layer 80*b* to differentiate the aesthetic sensibility in design and by varying the thickness or the added amount of each of the first transparent layer 70*a* and the second transparent layer 70*b*, with respect to the first phosphor layer 60*a*.

For example, the fifth integrated structure type hidden lens 30 is composed of a lens 40—a second phosphor layer 60*b*—a second transparent layer 70*b*. The fifth separated structure type hidden lens 30 is composed of a lens 40—a lens air gap Lb (or a second air gap Lb)—a second phosphor layer 60*b*—a second transparent layer 70*b*. In addition, the sixth integrated structure type hidden lens 30 is composed of a lens 40—a first phosphor layer 60*a*—a second transparent layer 70*b*. The sixth separated structure type hidden lens 30 is composed of a lens 40—a lens air gap Lb (or a second air gap Lb)—a first phosphor layer 60*a*—a second transparent layer 70*b*.

In this arrangement, the lens 40 is a transparent lens, and the first phosphor layer 60*a* and the second phosphor layer 60*b* are formed of phosphor that converts light having a 400 nm to 500 nm wavelength to light having a long wavelength of 400 to 700 nm. Further in this arrangement, the second transparent layer 70*b* is added with an LED color-based additive and other additives to protect the first phosphor layer 60*a* or second phosphor layer 60*b* while blocking a part of light.

Therefore, the fifth integrated/structure type hidden lens 30 or the sixth integrated structure type hidden lens 30 may be formed differently by employing various kinds of materials to be combined with the phosphor in the first phosphor layer 60*a* and the second phosphor layer 60*b* to provide different fluorescent colors with different CRIs. Further, the fifth integrated/structure type hidden lens 30 or the sixth integrated structure type hidden lens 30 may be formed differently by varying the thickness or the added amount of the second transparent layer 70*b* with respect to the first phosphor layer 60*a* or the second phosphor layer 60*b*.

For example, the seventh integrated structure type hidden lens 30 is composed of a plastic exterior part 40-1 or a color plastic exterior part 40-2—a first phosphor layer 60*a*—a first transparent layer 70*a*. The seventh separated structure type hidden lens 30 is composed of a plastic exterior part 40-1 or a color plastic exterior part 40-2—a lens air gap Lb (or a second air gap Lb)—a first phosphor layer 60*a*—a first transparent layer 70*a*.

In addition, the eighth integrated structure type hidden lens 30 is composed of a plastic exterior part 40-1 or a color plastic exterior part 40-2—a first phosphor layer 60*a*—a second transparent layer 70*b*. The eighth separated structure type hidden lens 30 is composed of a plastic exterior part 40-1 or a color plastic exterior part 40-2—a lens air gap Lb (or a second air gap Lb)—a first phosphor layer 60*a*—a second transparent layer 70*b*.

In addition, the ninth integrated structure type hidden lens 30 is composed of a plastic exterior part 40-1 or a color plastic exterior part 40-2—a second phosphor layer 60*b*—a second transparent layer 70*b*. The ninth separated structure type hidden lens 30 is composed of a plastic exterior part 40-1 or a color plastic exterior part 40-2—a lens air gap Lb (or a second air gap Lb)—a second phosphor layer 60*b*—a second transparent layer 70*b*.

In this arrangement, the plastic exterior part 40-1 and the color plastic exterior part 40-2 are outer lenses that replace the lens 40 and a painting layer or a deposition layer attached thereto. The first phosphor layer 60*a* and the second phosphor layer 60*b* are formed of phosphor that converts light having a wavelength of 400 nm to 500 nm to light having a long wavelength of 400 to 700 nm. The first transparent layer 70*a* and the second transparent layer 70*b* are added with an LED color-based additive and other additives to protect the first phosphor layer 60*a* or the second phosphor layer 60*b* while blocking a part of light.

In particular, each of the first phosphor layer 60*a* and the second phosphor layer 60*b* is applied with combined physical properties of the phosphor to correct a color shift caused by a combination of color of the color plastic exterior part 40-2 and the phosphor.

Therefore, the seventh integrated structure type hidden lens 30, the eighth integrated structure type hidden lens 30, or the ninth integrated structure type hidden lens 30 may be selectively formed by employing various kinds of materials to be combined with the phosphor in the first phosphor layer 60*a* and the second phosphor layer 60*b* to provide different fluorescent colors with different CRIs. Further, the seventh integrated structure type hidden lens 30, the eighth integrated structure type hidden lens 30, or the ninth integrated structure type hidden lens 30 may be selectively formed by varying the thickness or the added amount of the first transparent layer 70*a* or the second transparent layer 70*b* with respect to the first phosphor layer 60*a* or the second phosphor layer 60*b*.

Figure 6:
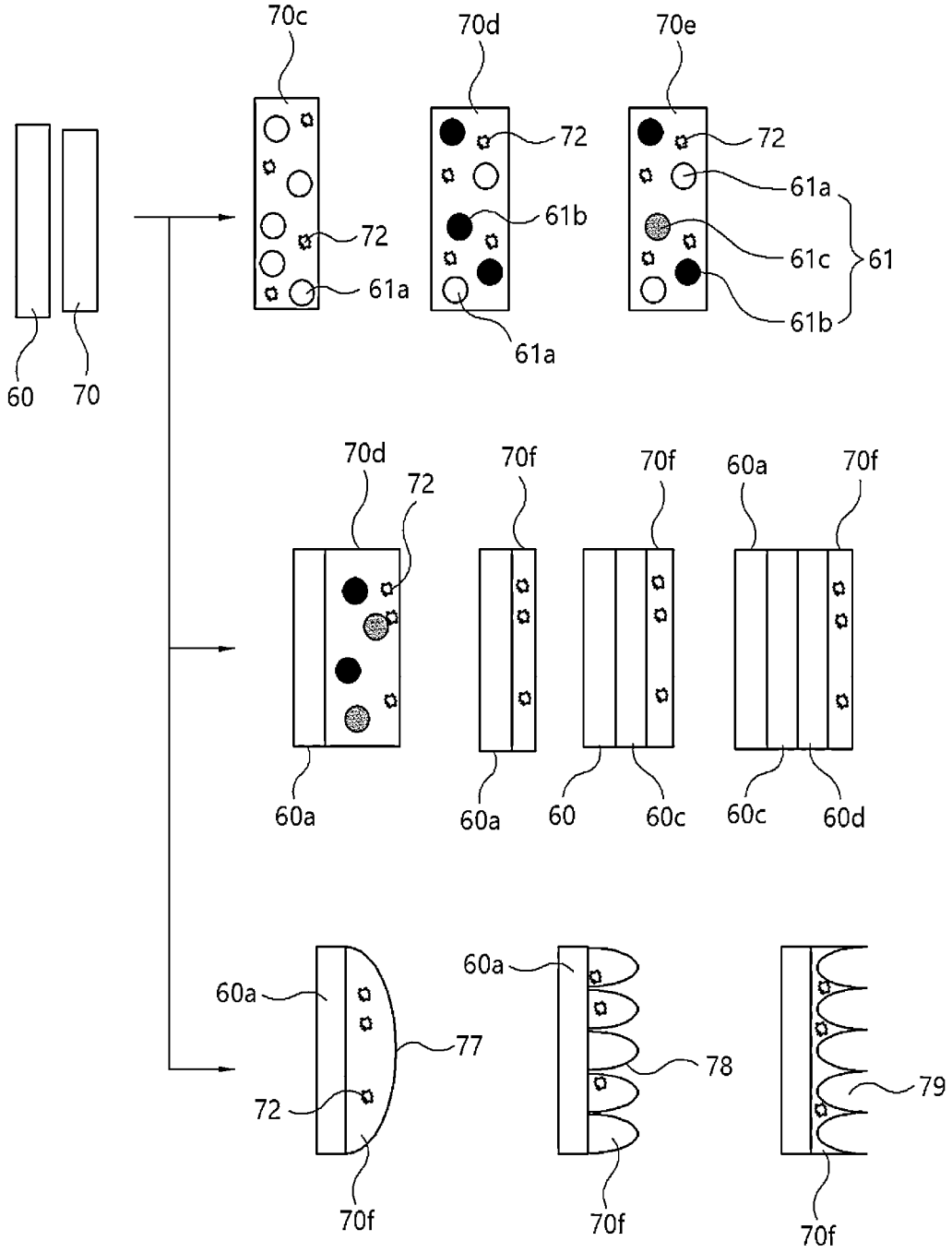
FIG. 6 is a diagram illustrating the use of phosphor among color conversion members constituting a hidden lens according to the present disclosure.

FIG. 6 illustrates various modifications and combinations of a phosphor layer 60 and a rear-phosphor layer 70 implemented into a color conversion member 50.

As illustrated, the color conversion member 50 is modified to have a phosphor layer 60, which is applied with any one kind of particles, including first color phosphor particles 61*a*, second color phosphor particles 61*b*, and third color phosphor particles 61*c*, as a phosphor particle 61, or with any one of a first phosphor layer 60*a*, a second phosphor layer 60*b*, a third phosphor layer 60*c*, and a fourth phosphor layer 60*d* as a modified structure.

In addition, the color conversion member 50 is modified to have a rear-phosphor layer 70, which is formed with the addition of an LED color-based additive as a base additive to block a part of light and an additional additive 72 to adjust the light transmittance. Alternatively, the color conversion member is modified to have any one of a third transparent layer 70*c*, a fourth transparent layer 70*d*, and a fifth transparent layer 70*e* other than the first and second transparent layers 70*a* and 70*b*, or an optical feature 70*f*.

Specifically, the color conversion member 50 combines the phosphor particles 61 (any one kind of particles among the phosphor particles 61*a*, 61*b*, and 61*c*) and the rear-phosphor layer 70, which is formed with any one of the third transparent layer 70*c*, the fourth transparent layer 70*d*, and the fifth transparent layer 70*e*, or with the optical feature 70*f*.

In particular, each of the third, fourth, and fifth transparent layers 70*c*, 70*d*, and 70*e* is added with an additional additive 72 to increase a light blocking function.

Therefore, the third transparent layer 70*c* contains the first color phosphor particles 61*a* together with the additional additive 72 to provide the first color of the phosphor particles as a lighting color while increasing the light blocking function.

In addition, the fourth transparent layer 70*d* contains the first color phosphor particles 61*a* and the second color phosphor particles 61*b* together with the additional additive 72 to provide a combined color of the first color and the second color of the phosphor particles as a lighting color while increasing a light blocking function.

In addition, the fifth transparent layer 70*e* contains the first color phosphor particles 61*a*, the second color phosphor particles 61*b*, and the third color phosphor particles 61*c* together with the additional additive 72 to provide a combined color of the first color, the second color, and the third color of the phosphor particles as a lighting color while increasing the light blocking function.

For example, the phosphor layer 60 may be modified to have a first phosphor layer 60*a*, which is combined with a fourth transparent layer 70*d* modified from the rear-phosphor layer 70, thereby obtaining harmony with the LED color of the light source 20 and light transmittance adjustment by the fourth transparent layer 70*d*.

Specifically, the color conversion member 50 combines the phosphor layer 60 modified into any one of the phosphor layers 60*a*, 60*b*, 60*c*, 60*d*, and the rear-phosphor layer 70. The phosphor layer 60 is modified into the first phosphor layer 60*a*, a combination of the first phosphor layer 60*a* and the third phosphor layer 60*c*, or a combination of the first phosphor layer 60*a*, the third phosphor layer 60*c*, and the fourth phosphor layer 60*d*.

Therefore, each of the phosphor layers 60*a*, 60*b*, 60*c*, and 60*d* may be combined with the optical feature 70*f*, which is one of the modified structures of the rear-phosphor layer 70. Thus, the diversified change of the phosphor color by the selective combination of the first, third, and fourth phosphor layers 60*a*, 60*c*, and 60*d* can be obtained, in addition to the harmony with the LED color of the light source 20 by the optical feature 70*f* and the light transmittance adjustment.

Furthermore, the optical feature 70*f* may be modified to have a shape of any one of a convex part 77, a concave part 78, and a Fresnel cut part 79, which can improve the optical performance.

Therefore, the color conversion member 50 may be configured such that the phosphor layer 60, modified into the first phosphor layer 60*a* among the phosphor layers 60*a*, 60*b*, 60*c*, and 60*d*, is combined with the convex part 77, the concave part 78, and the Fresnel cut part 79 of the rear-phosphor layer 70, which is modified into the optical feature 70*f*, to improve optical performance. The first phosphor layer 60*a* can effectively utilize LED light of the light source 20 through the convex part 77/the concave part 78/the Fresnel cut part 79.

Figure 7:
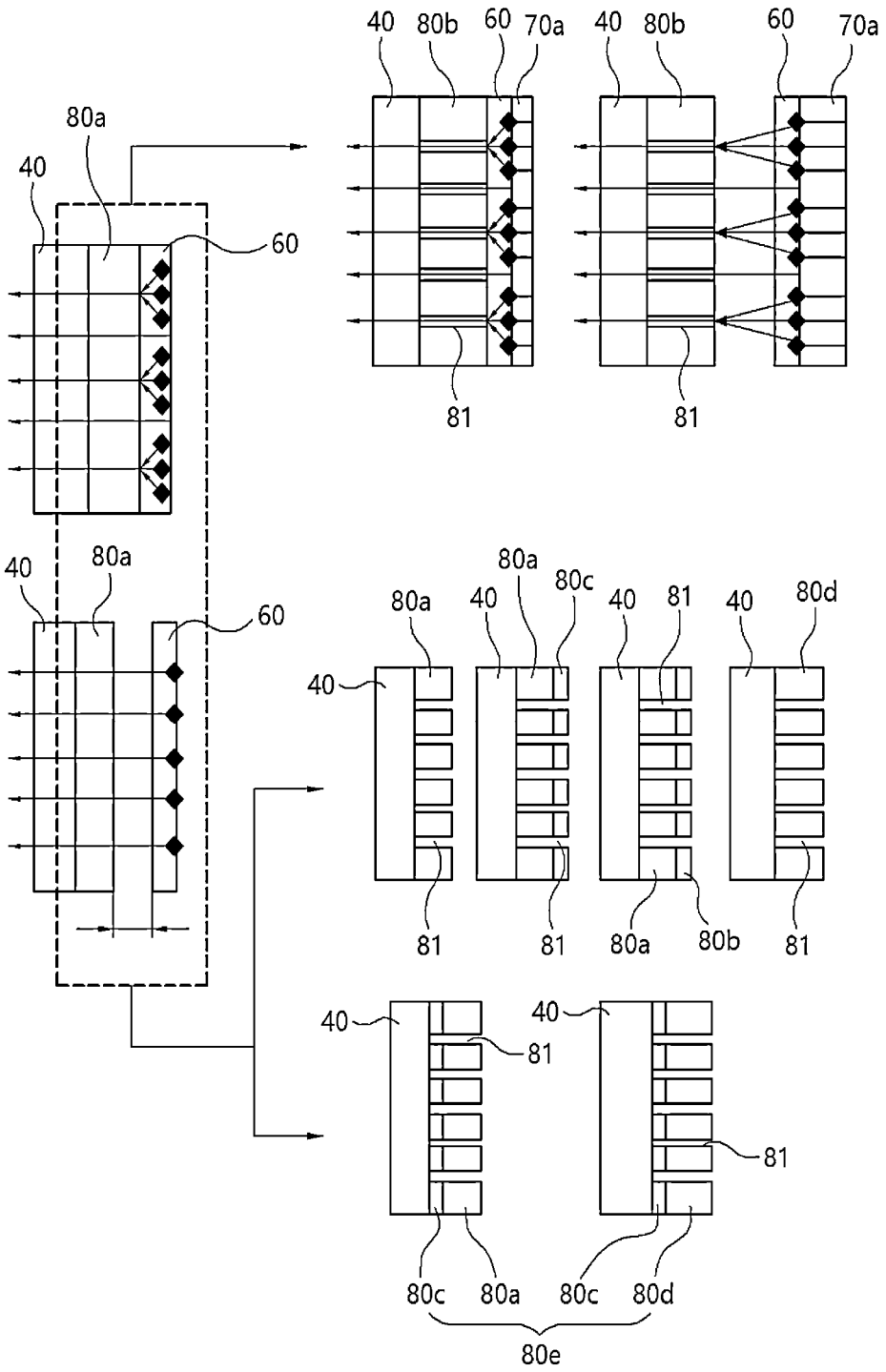
FIG. 7 is a diagram illustrating the configuration in which a deposition/cover/coating layer among color conversion members constituting an integrated/separated-type hidden lens is variously configured together with a light transmittance hole according to the present disclosure.

FIG. 7 illustrates various modifications to the front-phosphor layer 80.

As illustrated, the front-phosphor layer 80 is modified into any one of a deposition layer 80*a*, a painting layer 80*b*, a top coating layer 80*c*, a color painting layer 80*d*, and a base coating layer 80*e*, which is perforated with light transmission micro-holes 81 when being applied to the integrated structure type hidden lens 30 or the separated structure type hidden lens 30. Thus, the light transmittance of the inside light transmitting through the front-phosphor layer 80 from the phosphor layer 60 is increased.

For example, the deposition layer 80*a* is attached to the lens 40 through Al or Ni—Cr deposition to reflect light. In addition, the painting layer 80*b* is attached to the lens 40 through painting of various colors to reflect light. The painting layer replaces the deposition layer 80*a*.

For example, the top coating layer 80*c* is formed on the deposition layer 80*a* to prevent peeling of the deposition layer 80*a*. In addition, the color painting layer 80*d* is applied with various colors for the aesthetic sensibility in design of the hidden lighting lamp 10.

For example, the base coating layer 80*e* is composed of a combination of the deposition layer 80*a* and the top coating layer 80*c* or a combination of the color painting layer 80*d* and the top coating layer 80*c*. The base coating layer is applied to facilitate the progress of deposition or painting when the characteristics of the deposition or of the coating do not match with the material characteristics of the lens 40.

In particular, the top coating, painting, and base coating may be applied as additional processing operations to prevent the deposition peeling occurring in a state in which a separate layer such as the phosphor layer 60 does not exist after the deposition layer 80*a* is applied.

Figure 8:
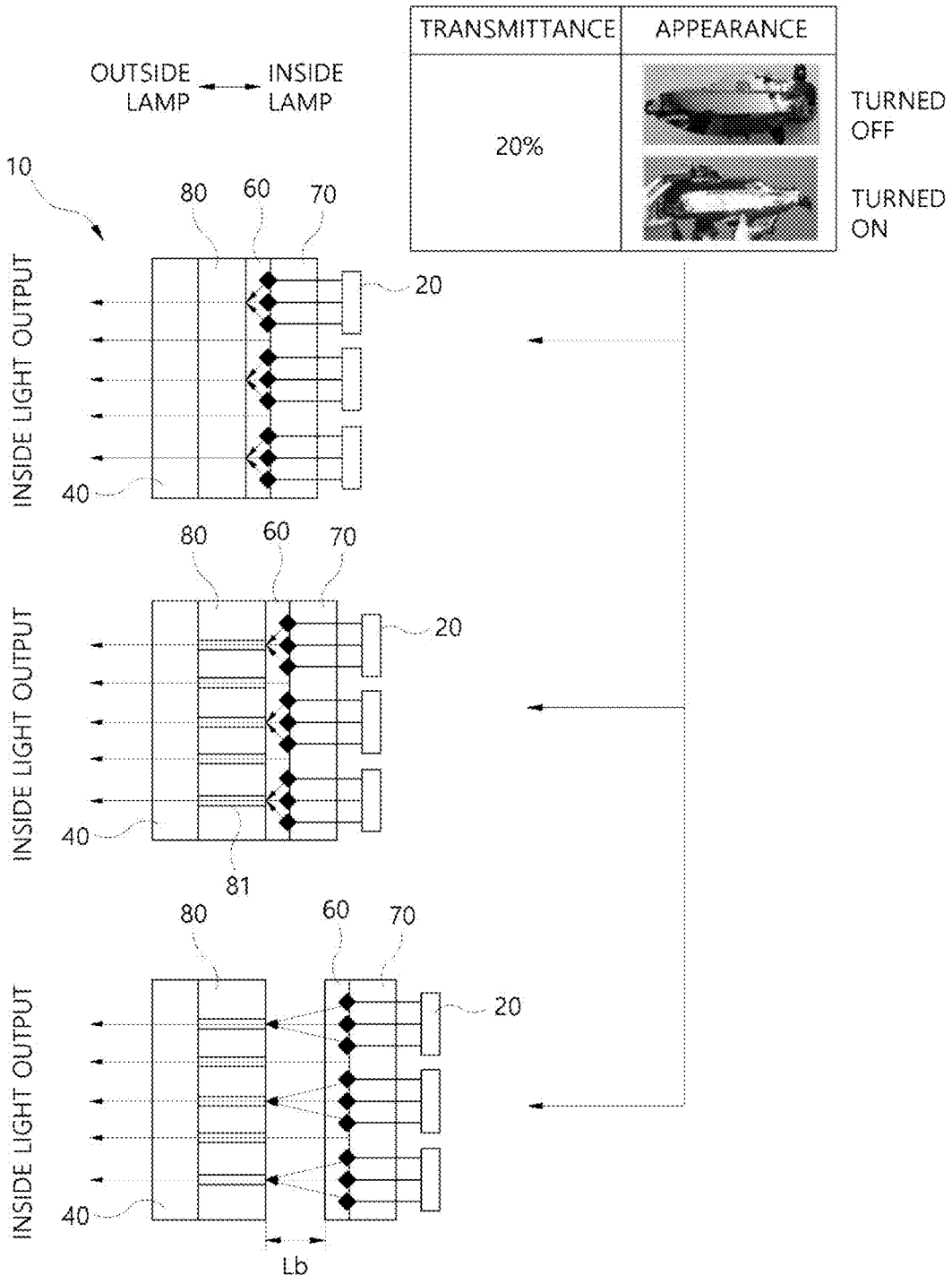
FIG. 8 is a diagram illustrating a lamp lighting state for each case structure of a hidden lighting lamp using a color conversion material according to the present disclosure.

FIG. 8 illustrates an external recognition state when the light source of the hidden lighting lamp 10 is not turned on and a lighting state when the light source is turned on. Although this case illustrates that the color conversion member 50 sets the LED light transmittance of the light source 20 to 20% compared to 100%, the transmittance of the color conversion member 50 may be diversely adjusted to have a range of 90% to 10%.

As illustrated, the hidden lighting lamp 10 includes a hidden lens 30 composed of a lens 40 and a color conversion member 50 consisting or comprised of a phosphor layer 60, a rear-phosphor layer 70 (or an LED color external light-blocking transparent layer), and a front-phosphor layer 80 (or a lens-attachment layer) to transmit the LED light of the light source 20 therethrough to provide illumination of the hidden lighting lamp 10.

In particular, the hidden lighting lamp 10 has light transmission micro-holes 81 perforated in the front-phosphor layer 80 (or the lens-attachment layer), which can increase the light transmittance of the light source 20.

Further, the hidden lighting lamp 10 is applied with an integrated structure type hidden lens 30 or a separated structure type hidden lens 30 with respect to the lens 40 with a light source air gap La (or a first air gap La) provided therein so that LED light does not rapidly increase the phosphor energy of the phosphor layer 60 in the inside lamp to secure VOCs robustness for phosphor, and with a lens air gap Lb (or a second air gap Lb) provided therein so that light exiting the phosphor layer 60 from the light source is scattered in the inside lamp to allow for effective use of light.

As described above, the hidden lighting lamp 10 using the color conversion material applied to a vehicle 1, according to the present embodiment, is configured so that the color conversion member 50 is spaced apart from the light source 20 by the light source air gap La (or the first air gap La) such that the color conversion member is integrally engaged with the lens 40 for projecting light of the light source 20 to the outside. Alternatively, the hidden lighting lamp 10, using the color conversion material, is configured such that the color conversion member is spaced apart from the lens 40 by the lens air gap Lb (or the second air gap Lb). Thus, the phosphor implementing color conversion and external concealment of the lamp inner space can implement hidden lighting in association with the lens 40 without deterioration of optical efficiency of the LED light of the light source 20.

In particular, according to the hidden lighting lamp 10 of the vehicle 1, phosphor is matched with one or more of a black painting, a coating layer, an application layer, and a deposition layer in the lens 40 to provide concealment of the lamp inner space, anti-peeling of a deposit, and diversity of fluorescent color. Further, the light source air gap La is provided between the LED of the light source 20 and the lens 40 to maintain VOCs robustness and to increase the light transmittance.

What is claimed is:

1. A hidden lighting lamp comprising:

a light source;

a lens projecting light of the light source to an outside of the hidden lighting lamp; and a color conversion member spaced apart from the light source by a first air gap to form a transmission path of light energy emitted from the light source, wherein the color conversion member includes a phosphor layer having a fluorescent material and a front-phosphor layer between the phosphor layer and the lens, wherein the front-phosphor layer forms an integrated structure or a separated structure with respect to the lens, wherein the front-phosphor layer is modified into any one of a deposition layer, a painting layer, a top coating layer, a color painting layer, and a base coating layer, and wherein a light transmission hole is formed in each of the deposition layer, the coating layer, the top coating layer, the color coating layer, and the base coating layer to increase light transmittance.

2. The hidden lighting lamp of claim 1, wherein the color conversion member is integrally engaged with the lens or separated from the lens by a second air gap, in a state of being spaced apart from the light source by the first air gap.

3. The hidden lighting lamp of claim 1, wherein the light source is a light-emitting diode (LED) chip.

4. The hidden lighting lamp of claim 1, wherein the phosphor layer is modified into a plurality of phosphor layers having different phosphor colors by varying a thickness or an added amount of phosphor material, wherein a phosphor composition change or a combination of the phosphor with other materials is performed to improve color rendering index (CRI).

5. The hidden lighting lamp of claim 1, wherein the phosphor layer is composed of a plurality of color phosphor particles having different phosphor color, and wherein the color phosphor particles are contained in the front-phosphor layer.

6. The hidden lighting lamp of claim 1, wherein the phosphor layer comprises a rear-phosphor layer having the same color base as a color of light from the light source and disposed between the light source and the phosphor layer, and wherein the rear-phosphor layer contains an additive having the same color base as the light from the light source and an additional additive to adjust light transmittance.

7. The hidden lighting lamp of claim 6, wherein the rear-phosphor layer is modified into a plurality of transparent layers each containing a plurality of color phosphor particles having different color.

8. The hidden lighting lamp of claim 1, wherein the color conversion member is modified into an optical feature having an optical function with any one of a convex part, a concave part, or a Fresnel cut part applied thereto.

9. The hidden lighting lamp of claim 1, wherein the deposition layer is formed of an aluminum (Al) material or a nickel-chromium (Ni—Cr) material.

10. The hidden lighting lamp of claim 1, wherein the painting layer is formed of a paint, and the color painting layer is formed of a paint of various colors suitable for realization of design aesthetics.

11. The hidden lighting lamp of claim 1, wherein the top coating layer is combined with the deposition layer to prevent delamination of the deposition layer.

12. The hidden lighting lamp of claim 1, wherein the base coating layer is combined with the deposition layer and the top coating layer to prevent delamination of the deposited layer or with the color painting layer and the top coating layer to prevent delamination of the color painting layer.

13. A vehicle comprising:

an exterior component; and a hidden lighting lamp according to claim 1 provided in a vehicle part where the exterior component is disposed and comprising a color conversion member integrally engaged with a lens for projecting light of a light source to the outside, or separated from the lens by a second air gap, in a state of being spaced apart from the light source by a first air gap.

14. The vehicle of claim 13, wherein the hidden lighting lamp is any one of a headlamp, a tail lamp, a fog lamp, a turn signal lamp, a side repeater, an emergency light, a brake lamp, and a backup lamp.

15. A hidden lighting lamp comprising:

a light source;

a lens projecting light of the light source to an outside of the hidden lighting lamp; and a color conversion member spaced apart from the light source by a first air gap to form a transmission path of light energy emitted from the light source, wherein the color conversion member includes a phosphor layer having a fluorescent material and a front-phosphor layer between the phosphor layer and the lens, wherein the phosphor layer is modified into a plurality of phosphor layers having different phosphor colors by varying a thickness or an added amount of phosphor material, and wherein a phosphor composition change or a combination of the phosphor with other materials is performed to improve color rendering index (CRI).

16. The hidden lighting lamp of claim 15, wherein the color conversion member is integrally engaged with the lens or separated from the lens by a second air gap, in a state of being spaced apart from the light source by the first air gap.

17. The hidden lighting lamp of claim 15, wherein the phosphor layer is composed of a plurality of color phosphor particles having different phosphor color, and wherein the color phosphor particles are contained in the front-phosphor layer.

18. The hidden lighting lamp of claim 15, wherein the color conversion member is modified into an optical feature having an optical function with any one of a convex part, a concave part, or a Fresnel cut part applied thereto.

19. A hidden lighting lamp comprising:

a light source;

a lens projecting light of the light source to an outside of the hidden lighting lamp; and a color conversion member spaced apart from the light source by a first air gap to form a transmission path of light energy emitted from the light source, wherein the color conversion member includes a phosphor layer having a fluorescent material and a front-phosphor layer between the phosphor layer and the lens, wherein the phosphor layer comprises a rear-phosphor layer having the same color base as a color of light from the light source and disposed between the light source and the phosphor layer, and wherein the rear-phosphor layer contains an additive having the same color base as the light from the light source and an additional additive to adjust light transmittance.

20. The hidden lighting lamp of claim 19, wherein the rear-phosphor layer is modified into a plurality of transparent layers each containing a plurality of color phosphor particles having different color.

* * * * *